US007654922B2

(12) United States Patent
Vassilev et al.

(10) Patent No.: US 7,654,922 B2
(45) Date of Patent: Feb. 2, 2010

(54) SPORTS BALL COMPRISING AUTOMATIC INFLATION MEANS AND METHOD TO MANAGE THE INTERNAL PRESSURE OF SUCH A BALL

(75) Inventors: Andréa Vassilev, Grenoble (FR); Roland Blanpain, Entre-Deux-Guiers (FR)

(73) Assignee: Commissariat A l'Energie Atomique, Paris (FR)

( * ) Notice: Subject to any disclaimer, the term of this patent is extended or adjusted under 35 U.S.C. 154(b) by 199 days.

(21) Appl. No.: 11/776,808

(22) Filed: Jul. 12, 2007

(65) Prior Publication Data

US 2008/0026886 A1 Jan. 31, 2008

(30) Foreign Application Priority Data

Jul. 25, 2006 (FR) ..... 06 53095

(51) Int. Cl.
*A63B 41/12* (2006.01)

(52) U.S. Cl. ..... 473/593; 473/570

(58) Field of Classification Search ..... 473/593, 473/570, 577, 594, 595; 446/220
See application file for complete search history.

(56) References Cited

U.S. PATENT DOCUMENTS

| | | | | | |
|---|---|---|---|---|---|
| 1,240,438 | A * | 9/1917 | Griffiths | 473/593 |
| 1,247,809 | A * | 11/1917 | Foster | 446/220 |
| 1,577,243 | A | 3/1926 | Bridges | |
| 1,921,108 | A * | 8/1933 | Twiss et al. | 473/593 |
| 1,969,128 | A * | 8/1934 | Harrison | 473/593 |
| 3,637,220 | A | 1/1972 | Fraley | |
| 4,385,767 | A * | 5/1983 | Colbourne | 273/359 |
| 4,898,561 | A * | 2/1990 | Nottingham et al. | 446/220 |
| 5,755,634 | A * | 5/1998 | Huang | 473/570 |
| 6,422,960 | B1 * | 7/2002 | Touhey et al. | 473/593 |
| 6,935,977 | B2 * | 8/2005 | Kennedy et al. | 473/593 |
| 2004/0242354 | A1 * | 12/2004 | Schomburg et al. | 473/593 |
| 2005/0159257 | A1 * | 7/2005 | Laliberty et al. | 473/593 |
| 2006/0154758 | A1 * | 7/2006 | Laliberty et al. | 473/593 |

FOREIGN PATENT DOCUMENTS

| | | |
|---|---|---|
| JP | 02185844 | 7/1990 |
| WO | 01-95982 | 12/2001 |
| WO | 2004-067098 | 8/2004 |

OTHER PUBLICATIONS

Search Report Dated May 3, 2007.

* cited by examiner

*Primary Examiner*—Steven Wong
(74) *Attorney, Agent, or Firm*—Pearne & Gordon LLP

(57) ABSTRACT

Sports ball, and more generally a pneumatic object with at least one internal pressure sensor (10) of said ball, automatic inflator (6), capable of compensating for a decrease in the internal pressure, this inflator having at least one gas micro-generator, said at least one micro-generator being capable of being actuated when the pressure sensor (10) measures an internal pressure below a predetermined threshold.

8 Claims, 1 Drawing Sheet

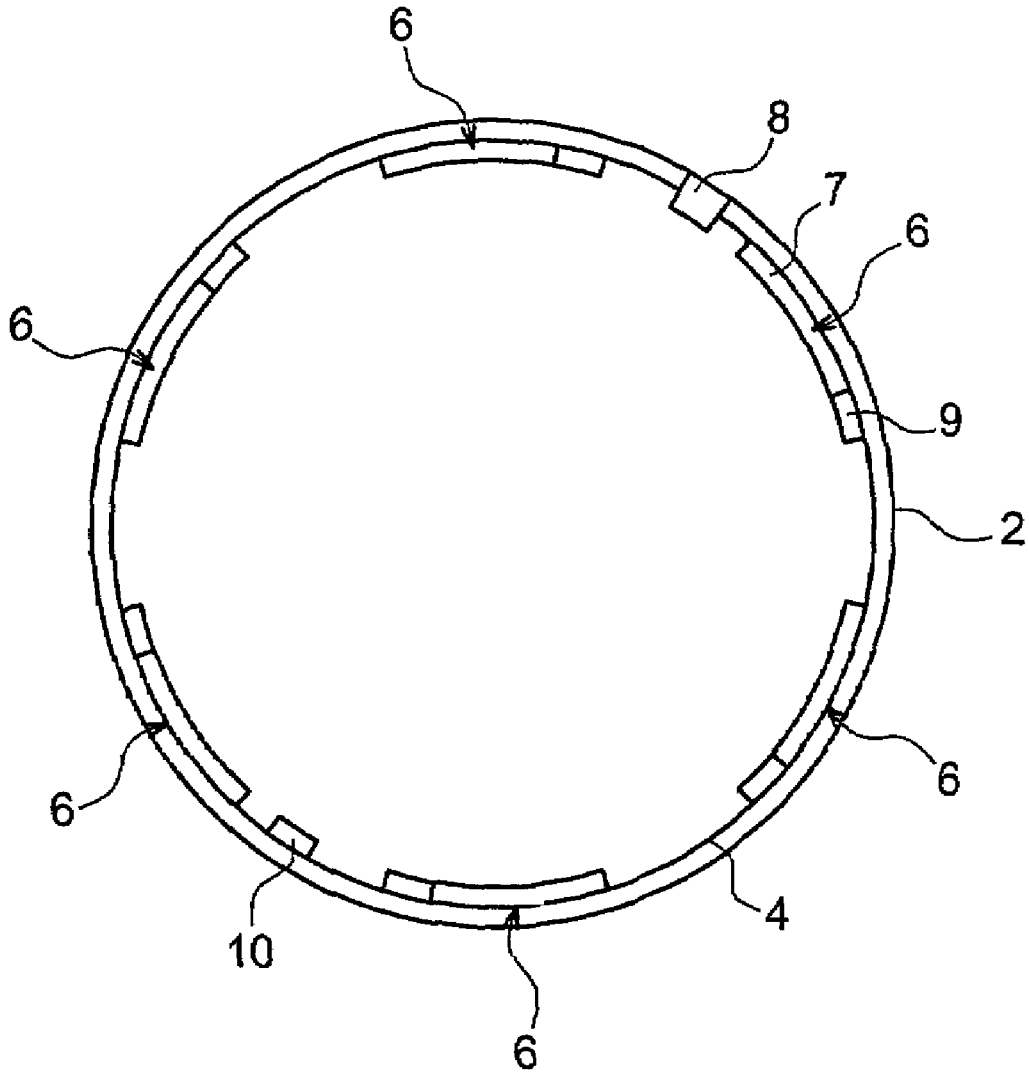
SINGLE FIGURE

SPORTS BALL COMPRISING AUTOMATIC INFLATION MEANS AND METHOD TO MANAGE THE INTERNAL PRESSURE OF SUCH A BALL

FIELD OF THE INVENTION AND STATE OF THE RELATED ART

The present invention relates to a sports ball and more generally to a pneumatic object intended to be used in the inflated state, for example, comprising automatic inflation means and to a method to manage the internal pressure of such a ball.

The pressure of soccer balls must be maintained at a given pressure, or at least within a given pressure range, so that the ball retains all its static characteristics, such as hardness and its dynamic characteristics, particularly the bounce height and speed, so that the playing quality during a match is not degraded.

However, due to the natural porosity of the ball envelope, the ball tends to deflate. In this way, in order to retain an acceptable pressure, team coaches are obliged to perform tedious reinflation of the balls during training sessions. Match referees, for their part, frequently verify the pressure of balls manually and replace them if they think that the pressure is too low.

Inflation requires having an inflation means, such as a hand pump or pneumatic compressor, available at all times. In the case of a hand pump, inflation is slow, may not be reproducible and may become tedious. In the case of a pneumatic compressor, it is bulky and is not available on the actual playing field.

In addition, inflation requires the insertion of a needle in a one-way valve, the risk of loss of the needle is not negligible.

From the documents WO 01/95982 and WO 2004/067098 A2, balls comprising integrated manually actuated pumps are known. In this way, the inflation means is always available. In this way, if the user considers that the ball pressure is not sufficient, he/she actuates the pump contained in the ball.

However, these integrated systems remain manually actuated; as a result, time is still wasted due to inflation and tiredness always results. Moreover, the assessment of the level of pressure remains subjective and requires periodical monitoring.

As a result, one of the aims of the present invention is to offer a sports ball, and more generally a pneumatic object intended to be used under given pressure conditions, used to free the user from monitoring and maintaining the internal pressure.

DESCRIPTION OF THE INVENTION

The aim described above is achieved with a sports ball and more generally a pneumatic object, comprising gas micro-generators activated to compensate for a decrease in the internal pressure of the object.

In other words, the pneumatic object is equipped. with a system used to provide a constant pressure inside a soccer ball, automatically and autonomously.

According to the invention, a pressure generator, for example, a gas generator, actuated according to the pressure measured and a predetermined pressure value is associated with a sensor of the internal pressure of the object.

As a result, the present invention essentially relates to a sports ball comprising at least one internal pressure measurement sensor of said object, automatic inflation means, capable of compensating for a decrease in the internal pressure, comprising at least one gas micro-generator, said at least one micro-generator being capable of being actuated when the pressure measurement sensor measures an internal pressure below a predetermined threshold.

Said micro-generator may comprise, for example a pyrotechnic formulation capable of igniting by means of a Joule effect and an electrical actuator capable of inducing the ignition of said formulation.

The pyrotechnic formulation may be solid propellant.

In an example of an embodiment, the electrical actuator comprises a capacitive circuit powered by a micro-battery.

In another example of an embodiment, the electrical actuator comprises a capacitive circuit powered by a device converting deformation energy of the object into electrical energy, of the piezoelectric device type.

The object according to the invention may also comprise an internal temperature sensor of the object.

The ball advantageously comprises several gas micro-generators distributed regularly so as to limit the unbalance effect.

The present invention also relates to a method to manage the internal pressure of a sports ball comprising several gas micro-generators, a pressure sensor comprising the following steps:

- measurement of the internal pressure of the sports ball by the pressure sensor,
- comparison of the pressure value with a threshold value,
- activation of at least one gas micro-generator if the pressure value measured is below the threshold.

Particularly advantageously, the activation of the micro-generators is performed in a predefined order to prevent an unbalance effect.

BRIEF DESCRIPTION OF FIGURES

The present invention will be understood more clearly using the following description and the single FIGURE appended representing a schematic cross-section view of a sports ball according to the present invention.

DETAILED DESCRIPTION OF SPECIFIC EMBODIMENTS

In the single FIGURE, a sports ball according to the present invention can be seen, comprising a flexible outer envelope 2 intended to come into contact with the outer environment, such as the ground and feet, in the case of a soccer ball.

The ball also comprises an air chamber 4 intended to be inflated under pressure and ensuring its hardness at the envelope 2.

A ball comprising a single envelope also forming an air chamber is also within the scope of the present invention.

The ball may advantageously comprise a valve 8 to enable a first inflation.

According to the present invention, the ball also comprises automatic inflation means 6 of the ball arranged in the air chamber, particularly attached on an inner surface of the air chamber 4.

These automatic inflation means 6 comprise, particularly advantageously, at least one gas generator fitted on the inner wall of the air chamber 4 of the ball.

The gas generator is of the type of those used in inflatable safety cushions for more vehicles, also referred to as Airbags® or for safety belt pre-tensioning devices, intended to protect occupants in the event of a collision.

The gas generator is not illustrated in a detailed manner.

The gas generator 6 particularly comprises:

a pyrotechnic formulation 7, for example of the propellant type, which, when ignited by a starter, generates a large volume of gas, generally nitrogen, an electric starter or actuator 9 which is intended to start the reaction by a Joule effect via an electric current.

The propellants used may be of several types. They are generally in solid form, for example in the form of compacted powder, for example consisting of an NaN3 base.

For example, it is possible to mention the performances of 10 g of an NaN3-based formulation, which are capable of generating 4.5 LNTP of nitrogen (LNTP: Liters at Normal Temperature and Pressure).

Nitrogenous formulations also exist that are liable to have up to 4 times higher yields, such as for example tetrazol wherein 10 g generates 20 LNTP.

Tetrazol has the advantage of having a lower combustion temperature of approximately 700° C. instead of 900° C., and generating non-toxic reaction products.

The automatic inflation means 6 also comprise at least one pressure sensor 10 to measure the pressure in the air chamber, in order to enable a comparison of the actual pressure value and a set-point value and act if applicable to adapt the actual value to the set-point value.

In this way, the gas generator is actuated according to the difference existing between the actual pressure in the ball and the predetermined set-point value, according to a logic defined elsewhere.

The pressure sensor is for example integrated in the valve of the balloon.

A sensor (not shown) of the internal temperature of the ball is also provided, used to correct the pressure measurement so as to obtain the most accurate measurement possible of the quantity of air in the sports ball.

The quantities of gas used are very small, and their very high temperature does not pose a problem for the sports ball.

The valve 8 is used to perform at least the first inflation of the ball.

The actuator 9 comprises, for example, a capacitive circuit, which may be powered either by the energy stored on a medium integrated in the inflation means 6, such as a micro-battery, or be supplied by a micro-system converting the deformation energy of the ball via piezoelectric means.

The use of a capacitive circuit offers the advantage of delivering a relatively high power of a few Watts in a very short time with a low energy, for example less than 0.1 mA.h for around ten starts.

The capacitance of the capacitive circuit advantageously has a high value, in order to supply the power required, said capacitance possibly being a single capacitance and being used for all the reactions. It is also possible to provide for a capacitive circuit for each of the gas generators.

The inflation means 6 supply a determined gas volume, and thus ensures an inflation of the ball at a given pressure for a specific time dependent on the porosity of the ball and the stress thereof.

We will now give an example of performance for a ball according to the present invention.

The volume of gas generation by a motor vehicle airbag ranges from 40 to 140 LNTP according to its function.

For example, the volume of a ball, inflated between 0.6 and 1.1 bar relative (i.e. 1.6 to 2.1 bar absolute) is 4.3 L, which is equivalent to 7 to 9 LNTP.

Assuming that, during a match or training session, a ball loses, due to the natural porosity of the envelope and/or the poor tightness of the valve, not more than 20% of its initial quantity of air. In this case, the ball loses 1.4 to 1.8 LNTP.

So that the ball pressure remains constant, a gas generator is activated once the pressure drops by 5%, which is equivalent to approximately 0.4 LNTP, i.e. the combustion of approximately 1 g of pyrotechnic formulation or 0.25 g of betrazol which remains a very low quantity.

In this way, taking into consideration a device comprising 24 micro-generators, each capable of generating 0.4 LNTP, the inflation means 6 make it possible to guarantee inflation at the set-point pressure for at least six matches or training sessions.

The inflation means 6 preferentially comprise several gas micro-generators liable to be used separately, each consuming a small mass of chemical compound.

Advantageously, the gas micro-generators are distributed uniformly on the inner envelope of the ball in order to balance the ball. In addition, it will be possible to provide for the management of their order of activation so as not to generate an excessive unbalance, providing for an order of activation. In fact, the static and dynamic balancing of the ball could be affected if the micro-generators are not positioned and/or used in a concerted manner.

The present particularly applies to sports balls, for example, soccer, basketball, handball or rugby balls.

The present invention also applies to all the pneumatic objects wherein it is required to maintain the pressure, for example in inflatable tubes, inflatable buoys or even inflatable life-jackets for which maintaining a certain level of inflation is very important.

The invention claimed is:

1. Sports ball comprising:

at least one internal pressure measurement sensor of said ball, an automatic inflator, capable of compensating for a decrease in the internal pressure, said automatic inflator comprising at least one gas micro-generator, said at least one microgenerator being capable of being actuated when the pressure measurement sensor measures an internal pressure below a predetermined threshold, wherein said micro-generator comprises a pyrotechnic formulation capable of igniting by means of a Joule effect and an electrical actuator capable of inducing the ignition of said formulation.

2. Sports ball according to the claim 1, wherein the pyrotechnic formulation is solid propellant.

3. Sports ball according to claim 1, wherein the electrical actuator comprises a capacitive circuit powered by a micro-battery.

4. Sports ball according to claim 1, wherein the electrical actuator comprises a capacitive circuit powered by a piezoelectric device converting deformation energy of the sports ball into electrical energy.

5. Sports ball according to claim 1, further comprising an internal temperature sensor for the ball.

6. Sports ball according to claim 1, comprising several gas micro-generators distributed regularly so as to limit the unbalance effect.

7. Method to manage the internal pressure of a sports ball comprising several gas microgenerators and a pressure sensor comprising the following steps:

measurement of the internal pressure of the sports ball by the pressure sensor, comparison of the pressure value with a threshold value made by a comparator in the sports ball, and activation of at least one gas microgenerator if the pressure value measured is below the threshold.

8. Method to manage the internal pressure of a sports ball according to claim 7, wherein the activation of the micro-generators is performed in a predefined order to prevent an unbalance effect.

* * * * *